United States Patent [19]

Buhler

[11] 4,023,578

[45] May 17, 1977

[54] BLOW-WAVE BRUSH

[75] Inventor: Harald Buhler, Ponchon, France

[73] Assignee: Etablissements Lardenois, Hermes, France

[22] Filed: Mar. 3, 1976

[21] Appl. No.: 682,757

Related U.S. Application Data

[63] Continuation of Ser. No. 550,972, Feb. 19, 1975, abandoned.

[30] Foreign Application Priority Data

Nov. 8, 1974 France ..... 74.37119

[52] U.S. Cl. ..... 132/9; 132/33 R

[51] Int. Cl.[2] ..... A45D 2/36

[58] Field of Search ..... 132/11, 9, 85, 33; 15/23

[56] References Cited

UNITED STATES PATENTS

| | | | |
|---|---|---|---|
| 2,172,024 | 9/1939 | Haluss | 15/23 |
| 2,400,723 | 5/1946 | Vrana | 132/120 |
| 3,150,393 | 9/1964 | Taylor et al. | 15/23 |
| 3,890,984 | 6/1975 | Lesetar | 132/9 |
| 3,894,547 | 7/1975 | Scivoletto | 15/23 |

*Primary Examiner*—G.E. McNeill

*Attorney, Agent, or Firm*—Merriam, Marshall, Shapiro & Klose

[57] ABSTRACT

A blow-wave brush for drying and styling the hair comprises a cylindrical heat-conducting cage surrounding a cylindrical brush, the tufts of the brush projecting beyond the surface of the cage. The brush is provided with means for blowing hot air into the cage. The hair is styled by contact with the hot cage and with the flow of hot air while being held in position by the tufts of the brush.

10 Claims, 6 Drawing Figures

BLOW-WAVE BRUSH

This application is a continuation of Ser. No. 550,972, filed Feb. 19, 1975, now abandoned.

The present invention reltes to a blow-wave brush, i.e. a hair-brush incorporating a hair-drier intended for treating the hair and in particular for effecting a so-called blow-wave.

It is known that, in order to obtain a well-presented hair style, the hair must be dried after having been washed, and brushed or combed to bring it into order, a suitable style being given thereto by a heat effect. To obtain the best result, these various operations should not be carried out successively, but almost simultaneously. In fact, if the hair is suitably heated, it is simultaneously dried and fixed in the desired shape, at the same time, it is, however, desirable to arrange the hair in order to obtain a pleasing overall effect.

Hairdressing accessories are already known which seek to procure a double effect, particularly by associating heat with a brushing or combing action.

Heating combs therefore already exist which are generally constituted by a conventional comb provided with teeth for bringing the hair into order and associated with a fan blowing hot air into the zone of action of the comb. Such a "blow-wave" comb seeks essentially to accelerate drying of the air, for example after a bath or a hair wash. However, it has no great effect on the style of the hair or locks, and conventional hair rollers or curlers must be used during drying or curling tongs.

Furthermore brushes also exist which are associated with a fan means for blowing hot hair into the brushing zone and which have substantially the same aim as the "blow-wave" combs. There again, these apparatus are essentially intended for facilitating drying of the hair, but they do not style it.

If it is desired to use the effect of heat to change the style of the hair, e.g. to form curls or waves, it is therefore necessary to use either rollers or curling tongs, whereby the hair is in direct contact with a heating surface that may change the texture of the hair and form curls. However, before, after or between each application of the curling tongs, a brush has to be used to tidy the hair. In addition, the sections of hair wound on the curling tongs are often not regularly spaced out and the user cannot guide the hair uniformly on the heated surface of the tongs.

The present invention relates to a hair-dressing device of the blow-wave brush type, enabling complex and new effects with respect to the known apparatus, to be obtained. In fact, by using one single apparatus, a complex treatment of the hair may be effected, including a mechanical tidying effect coupled with a heat effect for shaping the hair or rendering it bouffant.

To this end, the invention provides for an apparatus for the treatment of the hair, comprising on the one hand a brush and on the other hand means for blowing hot air into the zone of action of the brush, said apparatus being characterised in that it comprises a cylindrical cage, made of heat-conducting material, e.g. metal, said cage surrounding the brush whose tufts pass therethrough and project from the outer surface thereof, whilst the means for blowing hot air blow inside said cage.

In this way, the said cage makes it possible:

to canalise the flow of hot air and direct it to the section of hair thereon and maintained in position by the tufts of the brush; wastage of hot air is thus avoided and efficiency is improved;

to store in its mass the heat of the hot air flow, this enabling the locks to be styled by contact with the hot body, constituted by the cage;

to prevent the hair from penetrating too deeply into the tufts of the brush, this enabling the sections wound on said brush to be easily wound off.

In an advantageous embodiment of the invention, said cylindrical cage is obturated at one of its ends, whilst it receives the hot air flow through the other.

When, in known manner, the blow-wave brush according to the invention comprises a hollow body forming handle, inside which the means for blowing hot air are arranged, it is advantageous if this body comprises an at least substantially cylindrical nozzle for evacuating the hot air, in whose extension is disposed the brush and cage assembly. The hollow body itself may be of elongated form, its cylindrical nozzle and the assembly then being disposed in line with said body.

The brush preferably comprises a cylindrical coaxial support inside said cage and on which are mounted the tufts of bristles. At one of its ends, the cylindrical support is integral with a disc that may obturate the cage, whilst as its other end, it comprises an extension serving to fix it to the hollow body. The cage may be secured to said cylindrical support by means of the obturation disc. For its part, the extension of the cylindrical support may cooperate with a sleeve, secured to the hollow body, mounted coaxially inside the nozzle thereof, to assemble the brush and cage on said body. Of course, the assembling between the sleeve inside the nozzle and the extension of the cylindrical support of the brush tufts may be provided so that the brush and cage assembly may rotate about the axis of said brush.

The cage may be formed by a cylindrical envelope comprising longitudinal slots through which aligned tufts of bristles of the brush project.

The invention will be more readily understood on reading the following description with reference to the accompanying drawings, in which.

Figure 1:
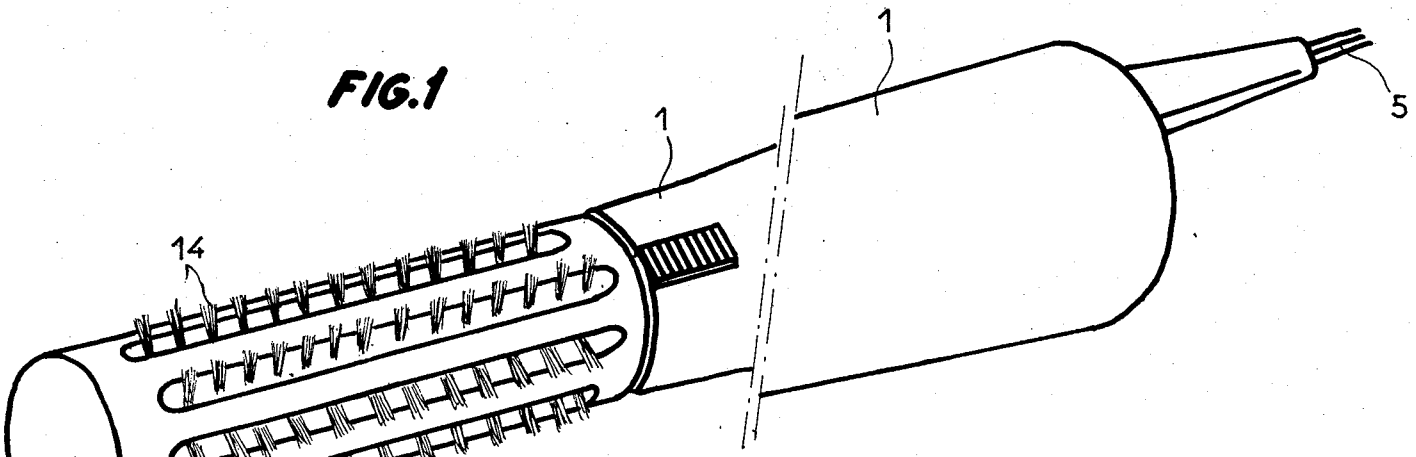
FIG. 1 is a perspective view of a blow-wave brush according to the invention.
Figure 6:
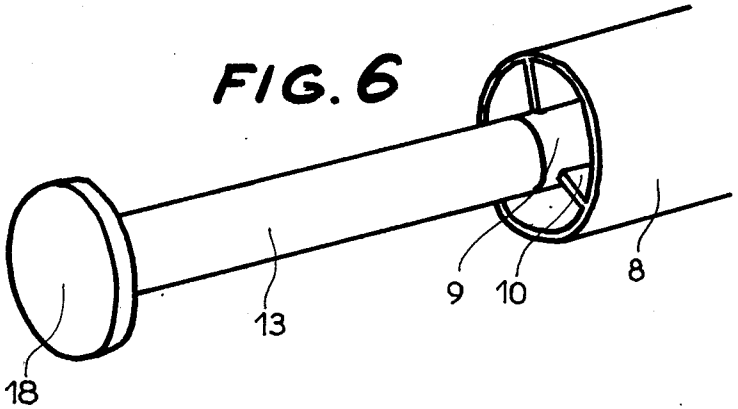
FIG. 6 shows in perspective the support of the tufts of bristles (assumed to be removed) of the brush according to the invention.
Figure 5:
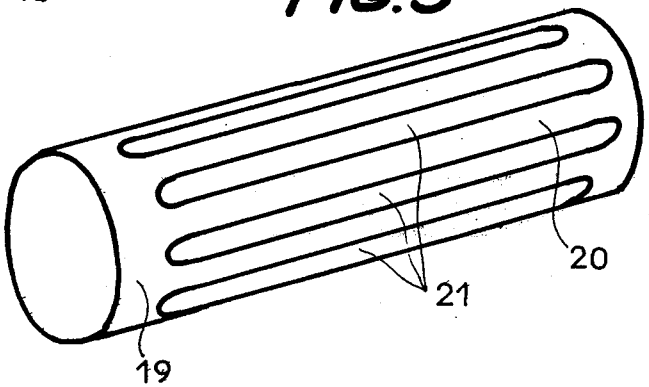
FIG. 5 is a perspective view of the cage of the brush of FIGS. 1 and 2.
Figure 2:
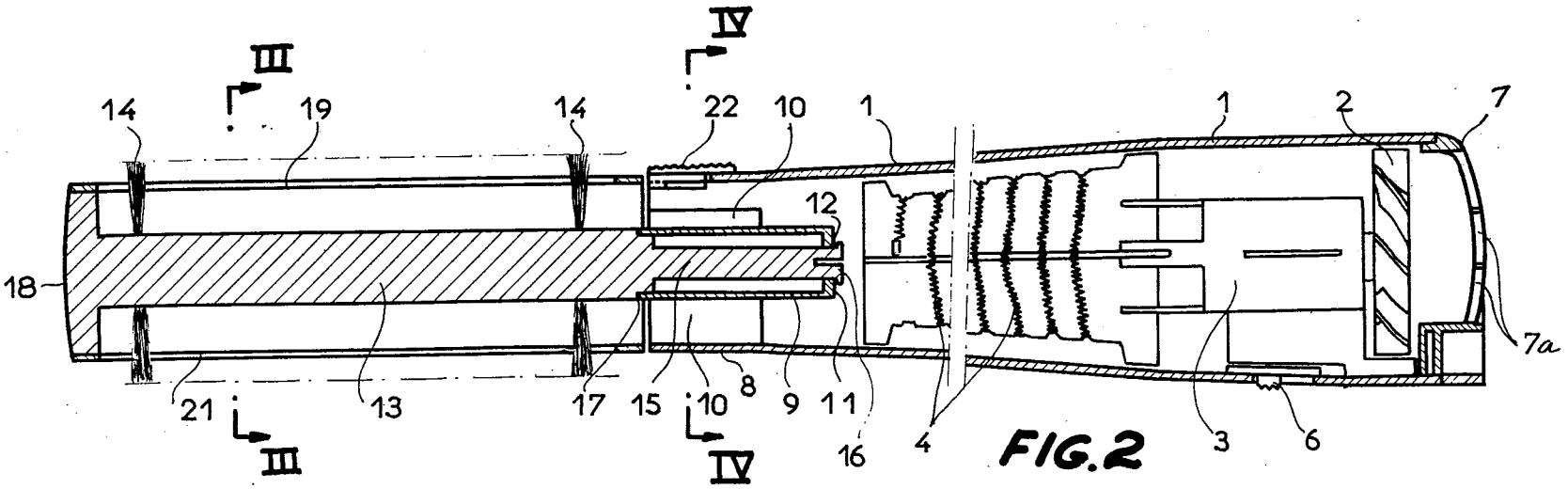
FIG. 2 is a longitudinal section through the brush of FIG. 1.
Figure 4:
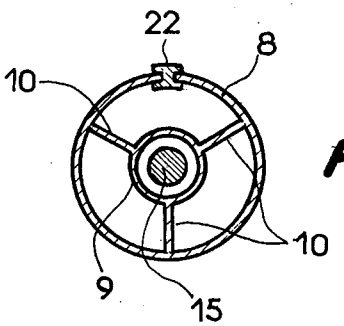
FIGS. 3 and 4 are sections along lines III—III and IV—IV of FIG. 2 respectively.
Figure 3:
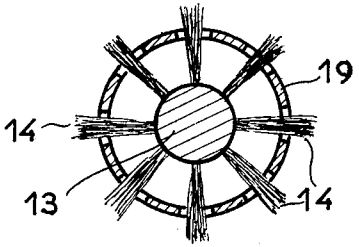

Referring now to the drawings, the blow wave brush according to the invention comprises a hollow elongated body 1, for example made of moulded plastics material, enclosing a fan 2 actuated by an electric motor 3, as well as electrical resistance 4 possibly associated with a thermostat (not shown). The motor and the resistance may be supplied from the mains via a lead 5 and switch 6.

Facing the fan 2, the body 1 is closed by an end wall 7 pierced with openings **7*a* through which fresh air is drawn in and subsequently blown over the resistances 4** where it is heated.

At its end opposite the end wall 7 the body 1 is shaped as a cylindrical nozzle 8 through which is ejected the hot air coming from the resistance 4 and blown by the fan 2. The nozzle 8 surrounds a coaxial inner sleeve 9 secured to the inner wall of said nozzle by webs 10. At the end nearest the resistance 4, the sleeve 9 is closed by an end wall 11 pierced with a central opening 22.

In line with the body 1 and the nozzle 8 is arranged an assembly composed of a rotary brush and a metal cage. The rotary brush comprises a cylindrical support 13 on which are mounted the tufts of bristles 14 of the brush.

At its end nearest the nozzle 8, the cylindrical support 13 is provided with an extension 15 whose split end 6 is elastically clipped into the opening 12. Furthermore, the cylindrical support 13 comprises a shoulder 17 which fits in the free end of the sleeve 9. Thus, the support may rotate about its longitudinal axis, with respect to the body 1.

At its end opposite the extension 15, the cylindrical support 13 is integral with a disc 18 on which is forcibly fitted a metal cage 19, e.g. made of Duralumin. The cage is coaxial with the support 13 and it completely surrounds same, to extend the nozzle 8. The cage 19 and the nozzle 8 have substantially equal diameters.

The cage 19 is constituted by a cylindrical envelope 20 in which are made longitudinal slots 21 through which pass the tufts of bristles 14 of the brush. These latter project from the outer surface of the envelope 20 (e.g. by about 4 or 5mm).

The rotation of the brush 13–14 and cage 19 assembly with respect to the body 1 may possibly be blocked by a slide 22 mounted on the body and able to cooperate with the cage 19.

It is thus seen that the hot air ejected through nozzle 8 penetrates into cage 19 and passes, like the tufts 14, through the slots 21. Moreover, the cage 19 being made of metal, it stores the heat of the hot air flow.

The blow-wave brush according to the invention therefore assembles in one apparatus a brush and drier which permits a hair treatment of the "blow wave" type. Apart from allowing passage of the hot air flow, the cage 19 permits a regular winding of the hair which is then in contact with a hot body. The sections of hair treated are therefore perfectly waved.

What is claimed is:

1. An apparatus for drying and styling the hair comprising:

an elongated cylindrical brush having tufts mounted around a central support;

a cylindrical heat-conducting cage surrounding and spaced from said support, the tufts of said brush passing through said cage and projecting beyond the outer surface thereof, and means for blowing hot air into said cage in a stream which is substantially uniform around the periphery of said central support;

said cage being provided with a plurality of openings therethrough, said openings being so distributed that said hot air escapes from said cage in a radial stream which is substantially uniform around the circumference of said cage, whereby said cage is substantially uniformly heated around its entire periphery.

2. An apparatus as defined in claim 1, wherein said cylindrical cage is closed at one end, while the other end receives the flow of hot air.

3. An apparatus as defined in claim 2 comprising a hollow body forming handle inside which are arranged the means for blowing hot air, wherein this body comprises an at least substantially cylindrical nozzle for evacuating the hot air, in whose extension is disposed the brush and cage assembly.

4. An apparatus as defined in claim 3, in which said hollow body is elongated in form wherein the at least substantially cylindrical nozzle and the brush and cage assembly are disposed in line with said body.

5. An apparatus as defined in claim 3, wherein the brush and cage assembly is mounted to rotate with respect to said hollow body so as to be able to rotate about the axis of said cage.

6. An apparatus as defined in claim 2 wherein at one of its ends, said central support is integral with a disc that obturates the cage, whilst at its other end, it comprises an extension serving to fix it to the hollow body forming handle.

7. An apparatus as defined in claim 6, wherein the obturator disc serves to connect the cage and the cylindrical support.

8. An apparatus as defined in claim 6, wherein the extension of the cylindrical support cooperates with a sleeve integral with the hollow body, mounted coaxially inside the nozzle of said latter to assemble the brush and cage on said body.

9. An apparatus as defined in claim 8, wherein the assembling between the sleeve inside the nozzle and the extension of the central support of the tufts of the brush is provided so that the brush and cage assembly can rotate about the axis of said brush.

10. An apparatus as defined in claim 1, wherein the cage is formed of a cylindrical envelope comprising longitudinal slots through which the tufts of bristles of the brush project.

* * * * *